US007014432B2

(12) United States Patent
Iwanari

(10) Patent No.: US 7,014,432 B2
(45) Date of Patent: Mar. 21, 2006

(54) FUEL PUMPING UNIT, WITH A PLURALITY OF COMMUTATOR BRUSH ASSEMBLIES WITH ENGAGING MEMBERS FOR RESTRICTING BRUSH MOVEMENT TOWARD THE PUMP MOTOR SECTION

(75) Inventor: Eiji Iwanari, Chiryu (JP)

(73) Assignee: Denso Corporation, (JP)

( * ) Notice: Subject to any disclaimer, the term of this patent is extended or adjusted under 35 U.S.C. 154(b) by 287 days.

(21) Appl. No.: 10/397,221

(22) Filed: Mar. 27, 2003

(65) Prior Publication Data

US 2003/0185693 A1 Oct. 2, 2003

(30) Foreign Application Priority Data

Mar. 28, 2002 (JP) ..... 2002-091305
Oct. 4, 2002 (JP) ..... 2002-292099
Dec. 20, 2002 (JP) ..... 2002-369576

(51) Int. Cl.
*F04B 17/03* (2006.01)

(52) U.S. Cl. ..... 417/423.7; 417/423.3; 417/423.1; 310/248; 310/242; 310/239; 310/245

(58) Field of Classification Search ..... 417/423.1, 417/423.3, 423.7; 310/248, 242, 239, 245
See application file for complete search history.

(56) References Cited

U.S. PATENT DOCUMENTS 3,392,295 A * 7/1968 Sebok ..... 310/228
3,871,797 A * 3/1975 Igarashi et al. ..... 417/423.3
4,475,053 A * 10/1984 Mayer ..... 310/239
5,064,342 A * 11/1991 Iwai ..... 415/55.1
5,081,386 A * 1/1992 Iwai ..... 310/87
5,123,809 A * 6/1992 Ito ..... 415/55.1
5,141,410 A 8/1992 Fujii
5,481,150 A * 1/1996 Tanaka et al. ..... 310/249
6,617,745 B1 * 9/2003 Reinartz et al. ..... 310/247
2004/0017126 A1 * 1/2004 Laurandel et al. ..... 310/242

* cited by examiner

*Primary Examiner*—Timothy S. Thorpe
*Assistant Examiner*—Emmanuel Sayoc

(74) *Attorney, Agent, or Firm*—Nixon & Vanderhye PC

(57) ABSTRACT

A fuel pump includes a housing, a pump section, a motor section including a commutator, a cover disposed at one end of the housing, a pair of brushes disposed in a pair of brush holes formed in the cover to be in contact with the commutator; and a pair of brush springs, disposed in a pair of spring holes formed in the cover, and an engaging member for restricting the brushes to move toward the motor section.

22 Claims, 6 Drawing Sheets

FUEL PUMPING UNIT, WITH A PLURALITY OF COMMUTATOR BRUSH ASSEMBLIES WITH ENGAGING MEMBERS FOR RESTRICTING BRUSH MOVEMENT TOWARD THE PUMP MOTOR SECTION

CROSS REFERENCE TO RELATED APPLICATION

The present application is based on and claims priority from Japanese Patent Applications: 2002-91305, filed Mar. 28, 2002; 2002-292099, filed Oct. 4, 2002; and 2002-369576, filed Dec. 20, 2002; the contents of which are incorporated herein by reference.

BACKGROUND OF THE INVENTION

1. Field of the Invention

The present invention relates to a fuel pump that pumps up fuel from a fuel tank and a method of manufacturing such a fuel pump.

2. Description of the Related Art

JP-Y2-7-47966 or its counterpart U.S. Pat. No. 5,141,410 discloses a fuel pump that supplies fuel to an engine from a fuel tank. The fuel pump is composed of a motor section and a pump section. Such a fuel pump has a brush unit that is accommodated in an armature body disposed at an end of the housing thereof. The brush unit includes a pair of brushes and a pair of coil springs that biases the brushes. Each brush is assembled into a subassembly with a choke coil and a connector, which is disposed in a hole formed in the armature body.

When the subassembly is mounted into the hole in which one of the coil springs is inserted beforehand, the brush has to be inserted against the biasing force of the spring. When the coil spring is inserted into the hole, the subassembly has to be held not to drop out from the armature body due to the biasing force of the coil spring. The fuel pump disclosed in the above-stated patent prevents the brushes from dropping out by a pig tail that connects the brush and the connector. However, the pig tail may snap off if the biasing force of the spring is applied to it for a long time until the armature body is fixed to the motor section.

SUMMARY OF THE INVENTION

A main object of the present invention is to provide a fuel pump that can solve the above-stated problem.

Another object of the invention is to provide a fuel pump that is easy to manufacture.

According to a feature of the invention, a fuel pump includes a pump section, a motor section including a commutator for driving the pump section, a cover having a pair of spring holes and a pair of brush holes, a pair of brushes disposed the brush holes, and a pair of brush springs, and an engaging member for restricting the brushes to move toward the motor section. Therefore, the brushes are prevented from dropping out from the cover, so that the brushes can be mounted in the cover easily.

In the above fuel pump the cover may have a fuel discharge passage at a central portion thereof. The above fuel pump may include a terminal member penetrating the cover to connect to a power source and a connection member connecting the brush and the engaging member. Thus, the connection member is not damaged by the brush springs.

In the fuel pump, the engaging member is electrically connected to the terminal member by the connection member, without providing an additional member. The terminal member and the brushes are preferably disposed at a half of an area of the cover divided by a center line that crosses the center of the cover, so that the terminal member and the brushes can be disposed at positions suitable for the fuel pump mounted in a vehicle. The engaging member may support the brushes whenever the brushes do not abut the commutator. Preferably, each of the brushes has a step portion that is engaged by the engaging member at a side of the motor section.

According to another feature of the invention, the engaging member may include a pair of engaging members disposed in a straight line. The engaging member may include a pair of engaging members disposed along a circumference of the cover.

According to another feature of the invention, one of the brushes, the terminal member, the engaging member and the connection member form a subassembly. Therefore, the number of components can be reduced when assembled into a fuel pump.

According to another feature of the invention, the terminal member may be disposed in one area of the cover that is divided by a center line crossing the center of the cover, and the brushes are disposed in the other area of the cover. Therefore, the terminal member and the brushes can be disposed at positions suitable for the fuel pump mounted in a vehicle. For example, if a fuel discharge passage is disposed at the central portion of the cover, the terminal member and the brushes are respectively disposed at areas divided by the center line, so that the space for the terminal member and the brushes can be easily provided.

According to another feature of the invention, the engaging member may have one end connected to the terminal member and the other end having an insert portion inserted to the cover. This prevents the terminal portion from bending. The engaging member may be disposed along the circumference of the cover or at a portion of the cover that is radially more outside than the brushes, so that the engage means can detour around the fuel discharge passage. Preferably, the engaging member supports the brushes whenever the brushes do not abut the commutator. The engaging member may engage a portion of the brushes that connect the connection member.

According to another feature of the invention, the fuel pump further includes a terminal member, and a connection member to form another subassembly.

According to another feature of the invention, a fuel pump includes a housing, a pump section disposed in said housing, a motor section disposed in the housing, a cover having a fuel discharge passage at the center thereof, a pair of spring holes and a pair of brush holes disposed in one half area of said cover that is divided by a center line crossing the center of the cover, a pair of brushes disposed in said pair of brush holes to be in contact with said commutator, and a pair of springs disposed in said pair of spring holes, and a pair of terminal members disposed in the other half area of said cover to penetrate said cover.

Therefore, the terminal members can detour around the discharge passage that is formed at a central portion of the cover, which can reduce the mounting space.

According to another feature of the invention, a method of manufacturing a fuel pump, which includes a pump section, a motor section having a commutator, a brush and a brush spring, a cover having a brush hole and a spring hole, a terminal member and a engaging member, is provided. The method includes the following steps: forming a subassembly that includes the brush, the terminal member and the engaging member; inserting the brush spring into the spring hole; force-fitting the terminal member into the cover to engage the engaging member with an end of the brush that is away from the spring; and inserting the brush into the brush hole against the biasing force of the brush spring. Therefore, the brush is prevented from dropping out from the cover when assembled. The method may further include a step of fitting an end of the engaging member into the cover after the step of inserting the brush into the brush hole. Therefore, the engaging member is prevented from excessively bending.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 1:
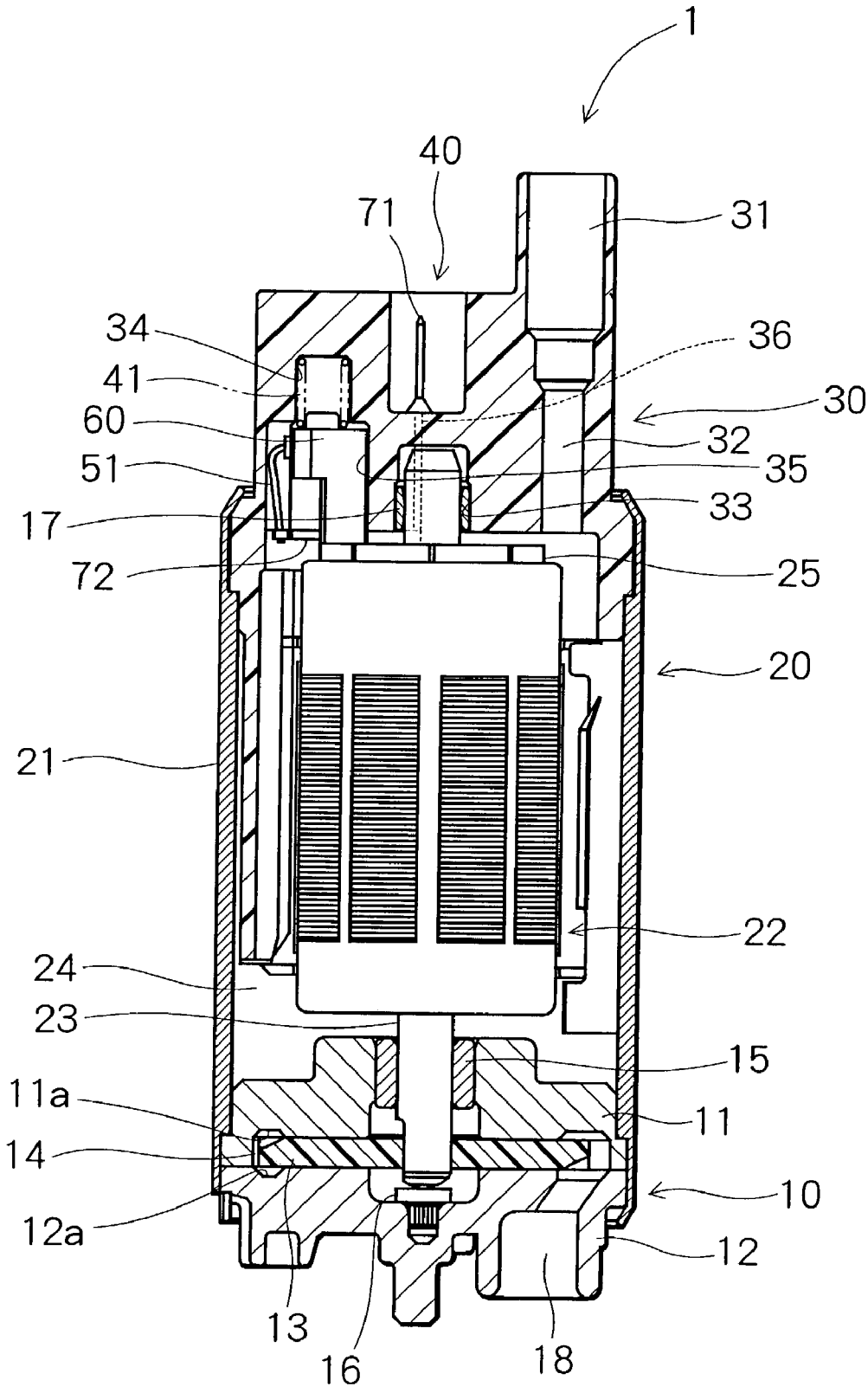
FIG. 1 is a longitudinal cross-sectional view of a fuel pump according to the first embodiment of the invention.

A fuel pump 1 according to the first embodiment of the invention will be described with reference to FIGS. 1–4.

The fuel pump 1 is composed of a pump section 10, a motor section 20 that drives the pump section 10, and a cover 30. The motor section 20 is a dc motor that has a brush unit, a housing 21 to which permanent magnets are fixed in the circumferential direction and an armature 22 disposed inside the permanent magnets.

The pump section 10 is composed of a casing 11, a casing cover 12, an impeller 13, etc. A pump passage 14 is formed between the casing 11 and the casing cover 12, and the impeller 13 is disposed inside the pump passage. The impeller 13 has a plurality of blades and blade ditches on the outer periphery thereof. The casing 11 and the casing cover 12 are made of aluminum die-casting. The casing 11 is fixed to an inside surface of an end of the housing 21 by clinching or the like. The casing 11 has a center hole to which a bearing 15 is force fitted. The casing cover 12 also has a center hole to which a thrust bearing 16 is force-fitted. The armature 22 has a rotary shaft 23, one end of which is rotatably supported by the bearing 15 and axially supported by the thrust bearing 16. The other end of the rotary shaft 23 is rotatably supported by a bearing 17.

The casing cover 12 has a fuel inlet port 18, through which fuel is pumped up from a fuel tank (not shown) when the impeller 13 rotates. The pump passage 14 includes a pressuring passage and a pressure damping passage, Fuel is pressured by the impeller 13 in the pressuring passage.

The fuel pumped in the pump passage 14 is pressured when the impeller 13 rotates and discharged from a fuel discharge port (not shown) formed in the casing 11 to a fuel chamber 24 of the motor section 20. A C-shaped pump groove 11*a* is formed at a portion of the casing around the impeller 13. A pump groove 12*a* is also formed at a portion of the casing cover 12 opposite the pump groove 11*a*.

The armature 22 that has a core and coils is rotatably disposed in the housing 21. A disk-shaped plane commutator 25 is disposed at the upper portion of the armature 22. When electric power is supplied to the coils of the armature 22 via a connector section 40 of the cover 30, the armature 22 and the shaft 23 rotate the impeller 13. When the impeller 13 rotates, fuel is pumped in the pump passage 14 from the fuel inlet port 18. The fuel is given kinetic energy by the blades of the impeller 13 and is discharged from the pump passage 14 through the fuel discharge port to the fuel chamber 24. The fuel discharged into the fuel chamber 24 passes along the peripheral portion of the armature 22 and is discharged from a fuel discharge pipe 31.

The cover 30 is disposed at the other end of the housing, which is away from the pump section. The cover 30 is made of resinous material and fixed to the housing 21 by clinching or the like. The cover 30 has a fuel discharge passage 32, a bearing hole 33, and the connector section 40. The fuel discharge passage 32 connects the fuel chamber 24 and the fuel discharge pipe 31. The bearing 17 is fitted to the bearing hole 33 to support the rotary shaft 23. The connector section 40 is formed at a portion of the cover 30 away from the pump and has a connector connected to a power source (not shown).

The cover 30 has a pair of spring holes 34, a pair of brush holes 35 and a pair of terminal holes 36. The spring hole 34 and the brush hole 35 are formed to connect each other in the axial direction of the cover 30. The spring holes 34 are formed on the end of the brush holes 35 away from the pump section 10. The cover 30 accommodates springs 41 and a subassembly shown in FIG. 2. The springs 41 are accommodated in the spring holes 34.

The subassembly 50 is composed of a brush 60, a terminal unit 70 and a connecting wire 51. The brush 60 has a step 61. The brush 60 is disposed in the brush hole 35 so that it can move in the axial direction. An end of the brush 60 abuts the spring 41 that is disposed in the spring hole 34, and the other end abuts the plane commutator 25, as shown in FIG. 1. Because the brush 60 is biased by the spring 41, it can be always in contact with the surface of the plane commutator 25.

The terminal unit 70 is a generally L-shaped member made of a conductive material and includes a terminal portion 71 and a plate portion 72. An end of the terminal portion 71 is force-fitted to the terminal hole 36 of the cover 30 so as to penetrate the cover 30 from a portion thereof on the side of the motor section 20, and the other end is disposed in the connector 40, as shown in FIG. 1.

Figure 3:
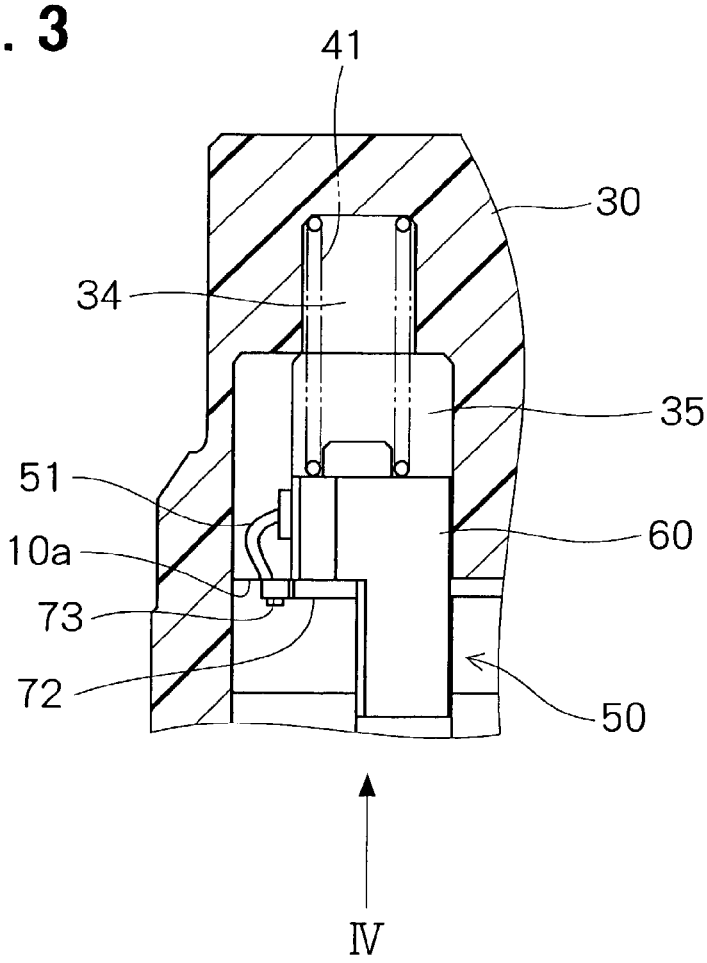
FIG. 3 is a fragmentary enlarged view of a portion of a brush of the fuel pump according to the first embodiment.

The connecting wire 51 is a soft and flexible conductive wire that connects the brush 50 and the terminal unit 70. One end of the connection wire 51 is connected to the brush 60 and the other end is connected to a bifurcated end 73 of the plate portion 72. The plate 72 has a rectangular cross-section. The other end of the plate 72 is integrally connected to the terminal portion 71. Because the brush 60 and the terminal unit 70 are connected by the soft and flexible wire 51, they can move relative to each other. The plate portion 72 is located at a portion of the brush 60 on the side of the motor section 20 so that it can engage the step portion 61 of the brush 60. The bifurcated end 73 of the plate portion 72 abuts the portion, as shown in FIG. 1. When the step portion 61 engages the plate portion 72, the brush 60 is restricted to further move toward the motor section 20, as shown in FIGS. 3 and 4.

Figure 4:
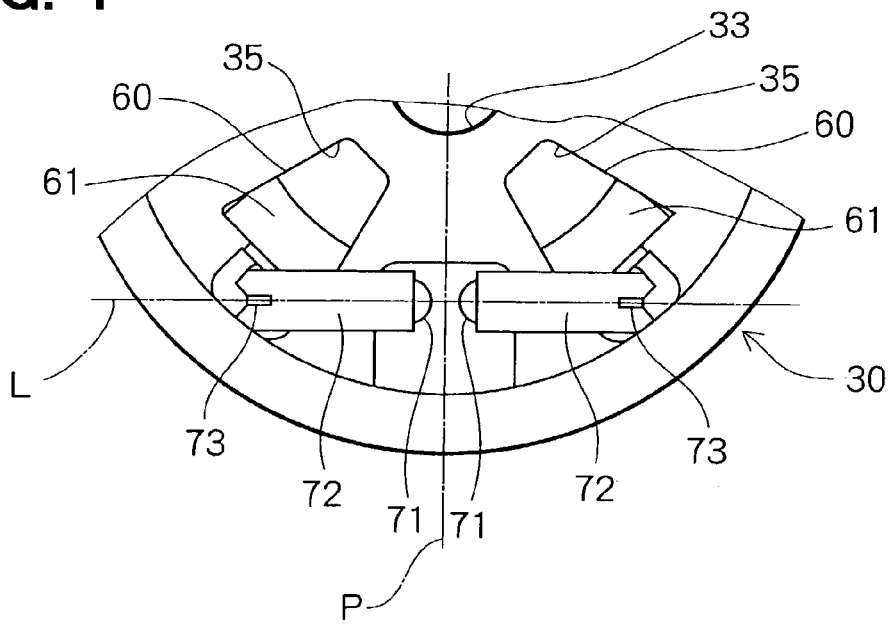
FIG. 4 is a fragmentary view of the portion shown in FIG. 3 viewed from position IV.

As shown in FIG. 4, a pair of the terminal units 70 is disposed in the cover 30 to be connected to plural electrodes of the motor section 20. The plate portions 72, which have a rectangular cross-section, are aligned with a straight line L. The terminal portions 71 are disposed on the same side as the brushes 60 in the radial direction of the cover 30. Two terminal units 70 are respectively disposed at portions of the cover 30 that are symmetrical with respect to a center line P extending through the middle of two terminal portions 71 and crossing the center of the cover 30. Therefore, the same terminal Units 70 can be used.

The fuel pump 1 is manufactured in the following manner.

Figure 2:
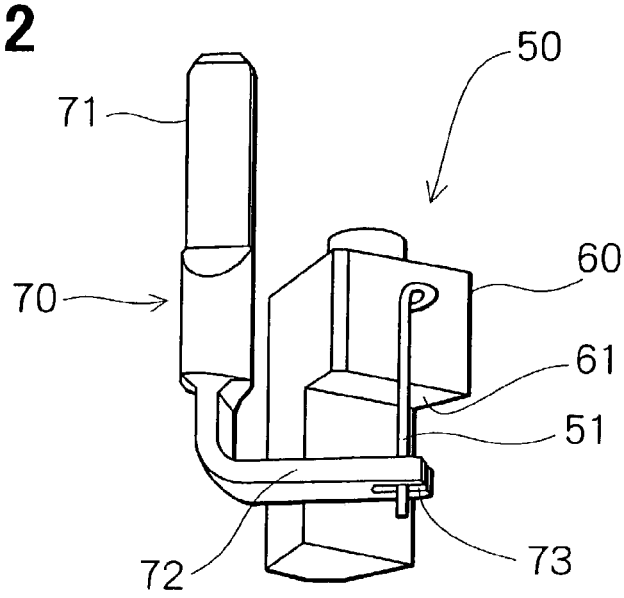
FIG. 2 is a perspective view of a subassembly of the fuel pump according to the first embodiment.

A pair of the subassemblies 50 is formed from the brushes 60, the terminal units 70 and the wires 51, as shown in FIG. 2. The brush 60 and the wire 51 are soldered or welded to each other. One end of the wire 51 is fixed to the bifurcated end 73 of the plate portion 72 by soldering or the like. Then, the springs 41 are respectively inserted into the spring holes 34 from the side facing the pump section 10 and the subassemblies 50 are mounted in the cover 30 with the brushes 50 being inserted into the brush holes 35 from the same side. The terminal holes 36 of the cover 30 is made smaller than the terminal portions 71 so that the terminal portions 71 can be force-fitted to the terminal holes 36. When the terminal portions are force-fitted to the cover 30, the brushes 60 are respectively inserted into the brush holes 35. Because the springs 41 are inserted into the spring holes 34, the brushes 60 are biased toward the motor section 20. However, the brushes 60 engage the plate portions 72, which prevent the brushes from dropping out. When the brushes 60 are inserted into the brush holes 35, the terminal portions 71 are force-fitted to the terminal holes 36 until the plate portions 72 abut surfaces 10*a* of the cover 30, as shown in FIG. 3.

Then the cover 30 having the springs 41 and the subassemblies 50 is fixed to one end of the housing 21 together with the pump section 10 and the motor section 20. The pump section 10 is fixed to the other end of the housing 21. When the cover 30, the pump section 10, the motor section 20 and the housing 21 are fixed together, the brushes 60 are brought into contact with the commutator 25 under the biasing force of the springs. The plate portions 72 hold the brushes 60 until the brushes are brought into contact with the commutator 25. Therefore, the biasing force of the spring 41 is not applied to the connecting wire 51. Because the plate portion 72 has a sufficient surface area that supports the spring 41 against the biasing force, the plate portion 72 is not damaged by the basing force.

Because the springs 41 and the subassemblies are mounted in the same direction, it is easy to manufacture the fuel pump 1.

Figure 5:
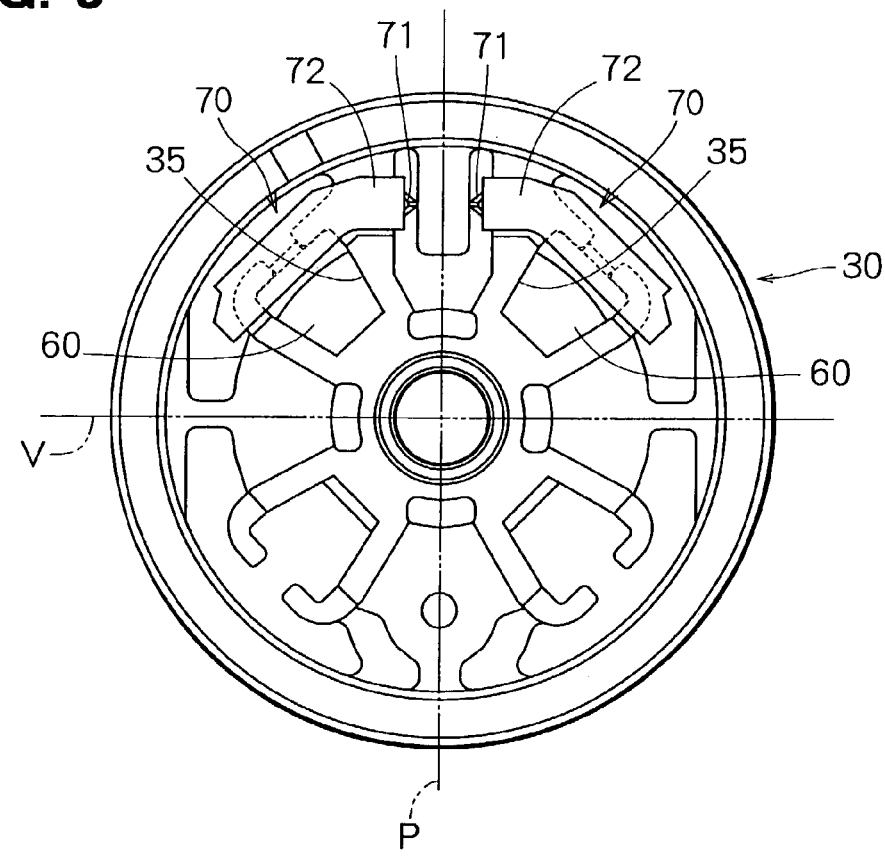
FIG. 5 is a front view of a cover of a fuel pump according to the second embodiment of the invention.

A fuel pump according to the second embodiment of the invention will be described with reference to FIG. 5.

Incidentally, the same reference numeral indicates the same or substantially the same member, portion or component as that of the first embodiment.

The fuel pump 1 has a pair of terminal portions 71, each of which is disposed in the same radial side of the cover 30 as one of the brushes 60. On the other hand, plate portions 72 each of which forms a terminal unit 70 are bent in the circumferential direction of the cover 30. Therefore, the plate portions 72 can be disposed in a limited space of the cover 30. The terminal unit 70 is disposed in the cover 30 symmetrically with respect to a center line P that crosses the center of the cover 30 and extends along the center line between the terminal potions 71. The cover 30 is divided by a line V into two sections, one of which includes the brushes 60 and the terminal portions 71.

Figure 7:
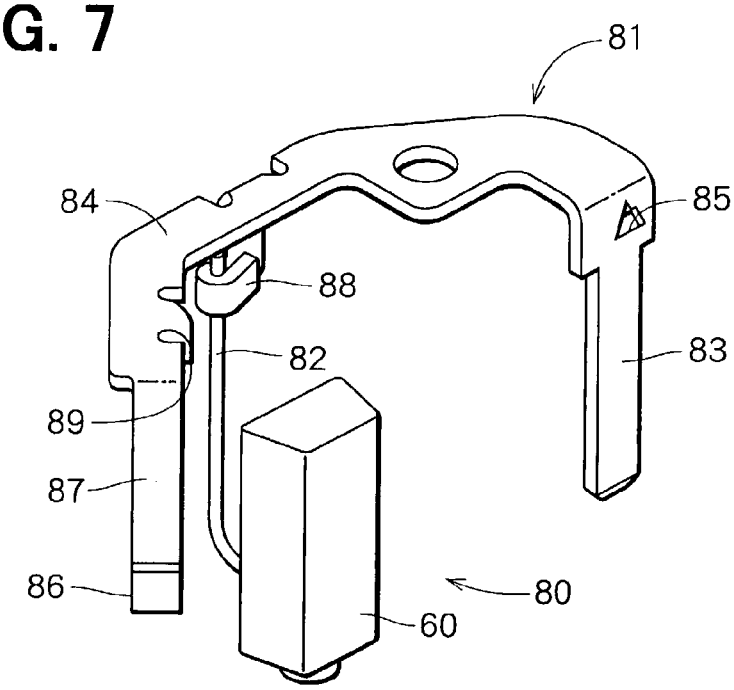
FIG. 7 is a perspective view of a subassembly of the fuel pump according to the third embodiment.
Figure 8:
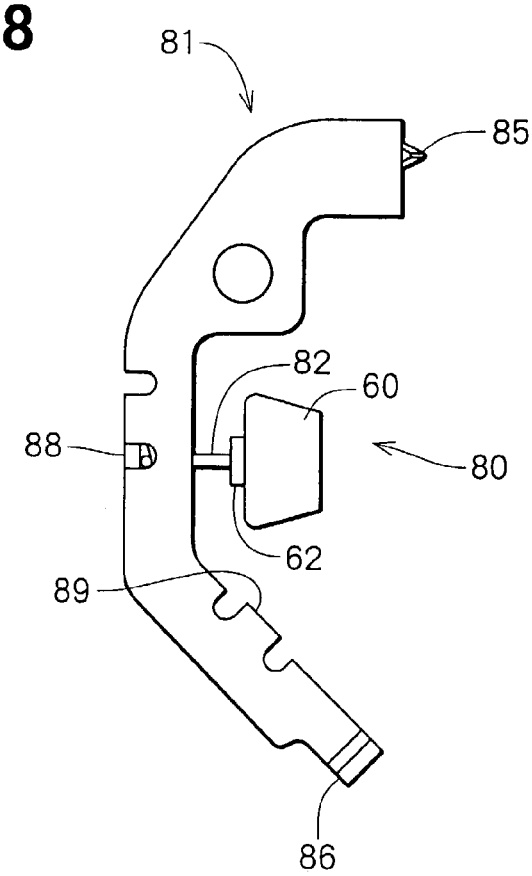
FIG. 8 is a plan view of the subassembly shown in FIG. 7.

A fuel pump according to the third embodiment of the invention will be described with reference to FIGS. 6–11. The shapes of two subassemblies 80 and 90 have a mirror-image relationship. The subassembly 80 includes a brush 60, a terminal unit 81 and a wire 82, as shown in FIGS. 7 and 8. The terminal unit 81 is made of a conductive material and has a terminal portion 83 and a plate portion 84. The subassembly 90 has the corresponding members that respectively have the mirror-image relationship with the terminal portion 83 and the plate portion 84. The terminal portion 83 is force-fitted to a terminal hole of the cover 30 that penetrates the cover 30. The terminal portion 83 is integrally formed with the plate portion 84 and bent to be perpendicular to the plate portion 84. A nail 85 is formed at a portion between the terminal portion 83 and the plate portion 84. When the terminal portion 83 is force-fitted to the cover 30, the nail 85 bites the cover 30, so that the terminal unit 81 can be held at a portion of the cover 30 on the side of the terminal portion 83. The wire 82 is made of a conductive soft metal such as copper.

Figure 9:
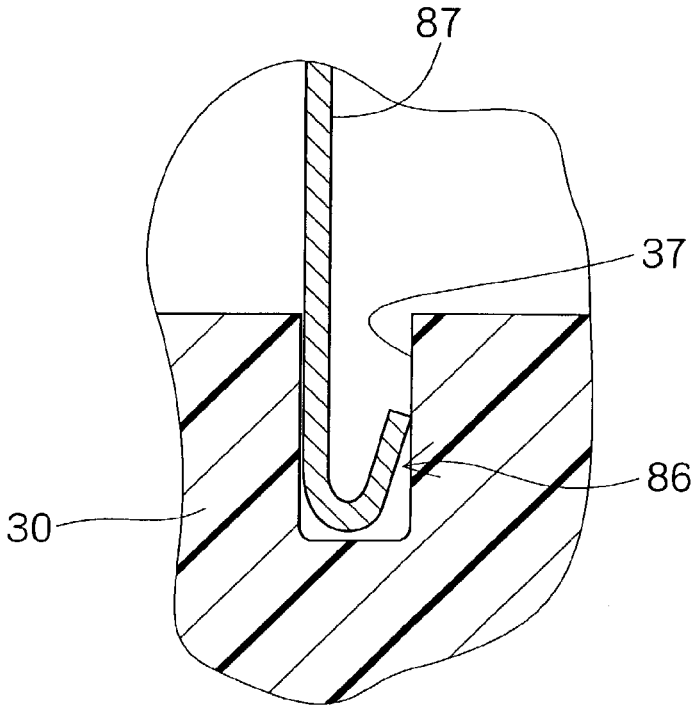
FIG. 9 is a fragmentary enlarged cross-sectional view of the cover shown in FIG. 6 cut along line IX—IX.

The plate portion 84 has an approximately arc-shape extending along the circumference of the cover 30, as shown in FIG. 8. The plate portion 84 has an insert portion 86 at an end of an arm portion 87 located opposite the terminal portion 83 and a holding portion 88 between the terminal portion 83 and the arm portion 87. The arm portion 87 is bent to extend in parallel with the terminal portion 83 as shown in FIG. 7. The insert portion 86 has a U-shaped bend that is thicker than a hole 37 so that the insert portion 86 can be held in the hole 37 by its elasticity, as shown in FIG. 9. Accordingly, the terminal unit 81 is held by the cover 30. The cover 30 has a pair of discharge passages 38.

The holding portion 88 has a U-shaped bend that holds one end of the wire 82, so that the brush 60 and the plate portion 84 are electrically connected by the wire 82.

Figure 6:
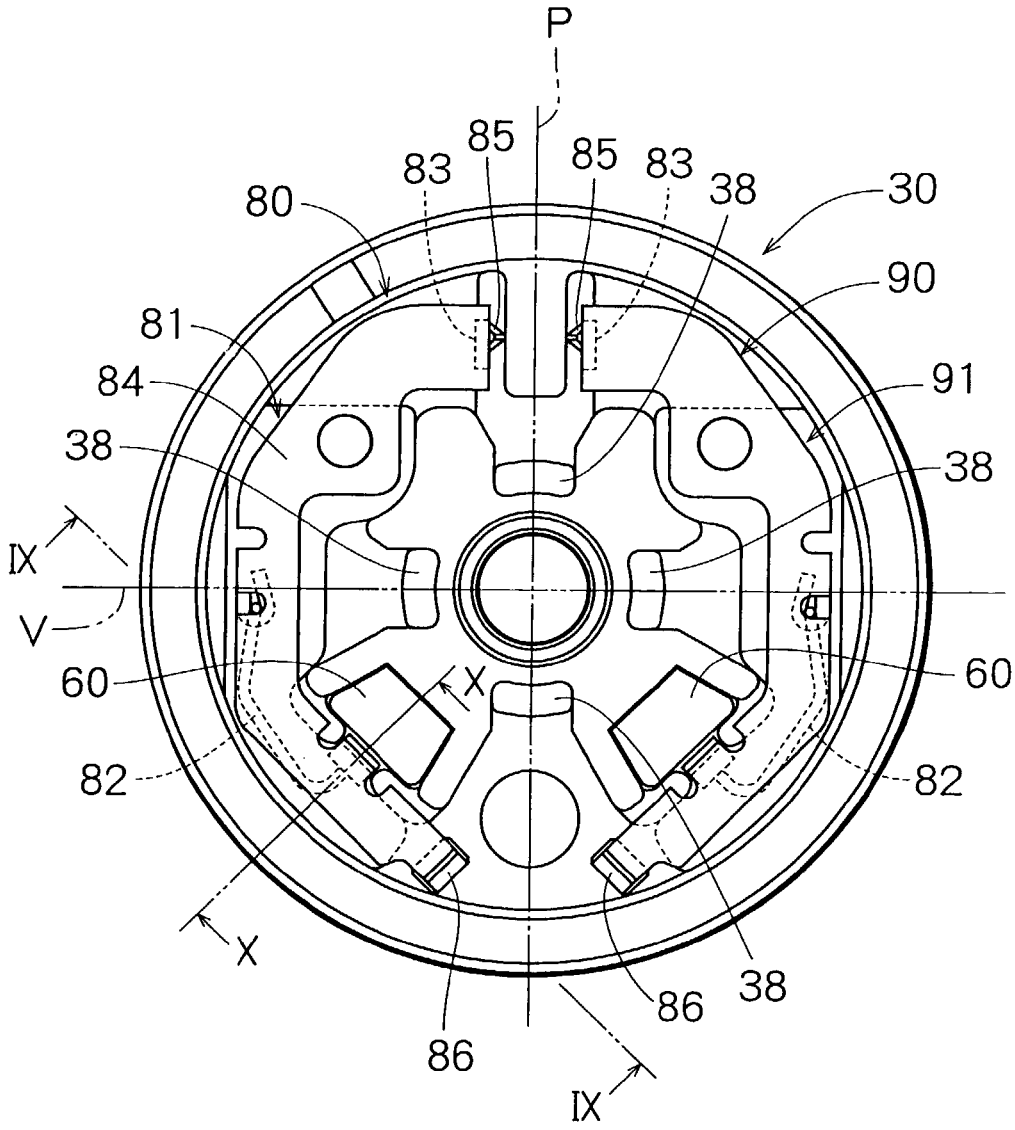
FIG. 6 is a front view of a cover of a fuel pump according to the third embodiment of the invention.
Figure 10:
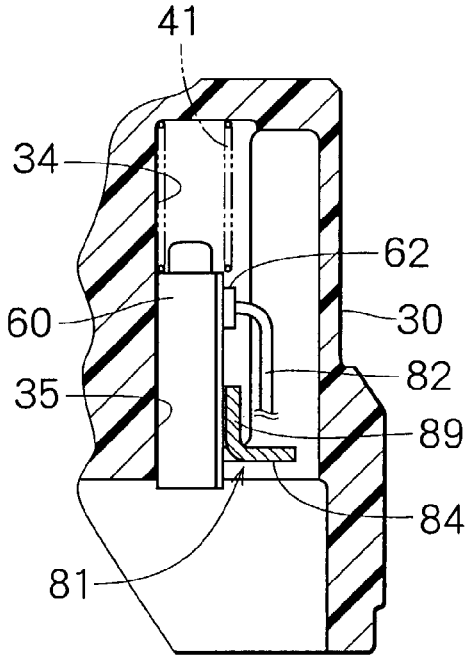
FIG. 10 is a fragmentary sectional view of the cover shown in FIG. 6 cut along line X—X.
Figure 11:
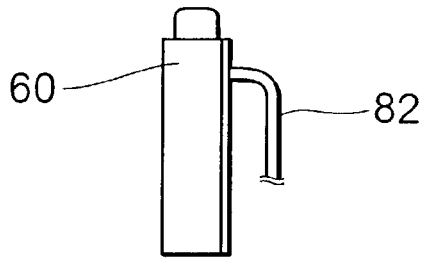
FIG. 11 is a schematic diagram showing a variation of the brush of the fuel pump according to the third embodiment.

As shown in FIG. 6, the plate portion 84 is in contact with the brush 60 at the end opposite the end of the terminal portion 83. In other words, the terminal portion 83 is located at a side of the cover 30 opposite the brush 60 in the radial direction. As shown in FIG. 7, the plate portion 84 has an engaging portion 89 that extends from the plate portion 84 in the same direction as the terminal portion 83 and the arm portion 87. As shown in FIG. 10, the engaging portion 89 has an end in contact with a connecting portion of the brush 60 to which the wire 82 is connected. The connecting portion may have a projection 62 as shown in FIG. 10 or may be flat as shown in FIG. 11.

The cover 30 has two subassemblies 80, 90. As shown in FIG. 6, the assembly 80 and the assembly 90 are disposed to have a mirror-image relationship with respect to a center line P. The cover 30 is divided by a center line V that is perpendicular to the line P into two sections. The terminal portions 83 are disposed in one section, while the brushes 60 are disposed in the other section, as shown in FIG. 6. The subassemblies 80, 90 have respectively arc-shaped plate portions 84 that extend along the circumference of the cover 30 to surround fuel discharge passages 38 that are formed at central portions of the cover 30. Therefore, the mounting space of the cover can be made minimal.

The fuel pump 1 is manufactured in the following manner.

The subassembly 80 is formed from the brush 60, the terminal unit 81 and the wire 82, as shown in FIGS. 7 and 8. The subassembly 90 is also formed in the same manner. The terminal portion 83, the plate portion 84, the nail 85, the insert portion, the arm portion 87, the holding portion and the engaging portion 89 are formed from the same plate as integral members of the terminal unit 81. The brush 60 and the wire 82 are soldered to be electrically connected. An end of the wire 82 extended from the brush 60 is connected to the holding portion 88. The wire 82 and the holding portion 88 may be connected by soldering.

When the fuel pump 1 is assembled, the springs 41 and the subassemblies 80, 90 are mounted in the cover 30. As shown in FIG. 10, each spring 41 is inserted into the spring hole 34 from the end of the cover 30 adjacent the pump section 10. Thereafter, the subassemblies 80, 90 are mounted from the same end of the cover 30.

When the brushes 60 are inserted into the brush holes 35, the terminal portions 83 are force-fitted to the terminal holes formed in the cover 30 until the plate portions 84 are brought into contact with surfaces of the cover 30. Accordingly, the brushes 60 are inserted deeper in the brush holes, and the nails 85 bite the cover 30. Although the brushes 60 are biased by the springs 41 outward, the engaging portions 89 restrict the brushes 60 to drop out by engaging the connecting portions of the brushes 60 and the wires 82. The insert portions 86 of the arm portions 87 are inserted into the hole 37 so that the terminal units 81 are fixed to the cover 30. As a result, the plate portions 84 are prevented from bending excessively.

Thus, the brushes 60 are restricted to further move by the engaging portions 89 and prevented from dropping out from the brush holes 35.

Then the cover 30 with the springs 41 and the subassemblies 80, 90 is fixed to the housing 21 together with the pump section 10 and the motor section 20. The pump section 10 is fixed to one end of the housing 21, and the cover 30 is fixed to the other end by clinching or the like. When the cover 30 is fixed to the housing 21 in which the motor section 20 has been fixed, the brushes 60 are brought into contact with the commutator 25 and pushed into the brush holes against the biasing force of the springs 41. As a result, brushes always slide on the commutator surface under the biasing force of the springs when the motor section 20 operates.

When the assemblies 80, 90 are mounted in the cover 30, the brushes 60 are supported by the engaging portions 89 at the base portions of the wires 82. Therefore, the brushes 60 is restricted by the engaging portions 89 when force for holding the brushes 60 is released after the brushes 60 are mounted. As a result, the brushes are prevented from dropping out from the cover 30 without damage caused by concentrated biasing force of the springs 41.

When the terminal portion 83 is force-fitted to the cover 30, the subassembly 80 is prevented from dropping out, and the brush 60 is supported by the engaging portion 89 at an end away from the spring 41. The spring 41 and the subassembly 80 are mounted in the cover 30 from the side of the pump section 10. This makes the assembling work easier.

The plate portion 84 of the subassembly 80 has an arc-shape extending along the circumference of the cover 30. The plate portion 84 is disposed at a radially outside portion of the brush 60. Therefore, even if the terminal portion 83 is disposed at an end away from the brush 60, the plate portion 83 can detour around the discharge passages 38 that are formed at central portions of the cover 30. This can reduce the mounting space of the cover 30.

In the foregoing description of the present invention, the invention has been disclosed with reference to specific embodiments thereof. It will, however, be evident that various modifications and changes may be made to the specific embodiments of the present invention without departing from the scope of the invention as set forth in the appended claims. Accordingly, the description of the present invention is to be regarded in an illustrative, rather than a restrictive, sense.

What is claimed is:

1. A fuel pump comprising:

a housing;

a pump section disposed in said housing;

a motor section including a commutator, disposed in said housing, for driving said pump section;

a cover disposed at an end of said housing on a side of said motor section, said cover having a pair of spring holes and a pair of brush holes;

a pair of brushes comprised of a brush body and a flexible connecting wire and disposed in said pair of brush holes to be in contact with said commutator each said brush body having a longitudinal axis and first and second axial ends, a contact surface for contacting a contact surface of the commutator being defined at said first axial end, each said brush further including an engaging surface axially spaced from said contact surface of said brush body, said engaging surface defined by one of: a surface of said brush body between said first and second axial ends of said brush body and an axial surface of said connecting wire; and a pair of springs, disposed in said pair of spring holes for biasing said brushes against said commutator; and at least one engaging member, disposed between said engaging surface and a contact surface of said commutator to selectively engage the engaging surface for limiting movement of said respective brush toward said motor section.

2. The fuel pump as claimed in claim 1, wherein said cover has a fuel discharge passage at a central portion thereof.

3. The fuel pump as claimed in claim 1, further comprising:

a terminal member penetrating through said cover to connect said engaging member to a power source; and a connection member for connecting the flexible connecting wire of said brushes and said engaging member.

4. The fuel pump as claimed in claim 3, wherein said engaging member is electrically connected to said terminal member.

5. The fuel pump as claimed in claim in claim 3, wherein said terminal member and said brushes are disposed at a half of an area of said cover divided by a center line that crosses the center of said cover.

6. The fuel pump as claimed in claim 5, wherein said engaging member supports said brushes when said brushes do not abut said commutator.

7. A fuel pump comprising:

a housing;

a pump section disposed in said housing;

a motor section including a commutator, disposed in said housing, for driving said pump section;

a cover disposed at an end of said housing on a side of said motor section, said cover having a pair of spring holes and a pair of brush holes;

a pair of brushes disposed in said pair of brush holes to be in contact with said commutator; and a pair of springs, disposed in said pair of spring holes for biasing said brushes against said commutator; and an engaging member for restricting said brushes to move toward said motor section, wherein each of said brushes has a step portion that is engaged by said engaging member at a side of said motor section.

8. The fuel pump as claimed in claim 5, wherein said engaging member comprises a pair of engaging members disposed in a straight line.

9. The fuel pump as claimed in claim 5, wherein said engaging member comprises a pair of engaging members disposed along a circumference of said cover.

10. The fuel pump as claimed in claim 5, wherein one of said brushes, said terminal member, said engaging member and said connection member form a subassembly.

11. The fuel pump as claimed in claim 3, wherein said terminal member is disposed in one area of said cover that is divided by a center line crossing the center of said cover, and said brushes are disposed in the other area of said cover.

12. The fuel pump as claimed in claim 11, wherein said engaging member has one end connected to said terminal member and the other end having an insert portion inserted to said cover.

13. The fuel pump as claimed in claim 11, wherein said engaging member is disposed along the circumference of said cover.

14. The fuel pump as claimed in claim 11, wherein said engaging member is disposed at a portion of said cover that is radially more outside than said brushes.

15. The fuel pump as claimed in claim 11, wherein said engaging member supports said brushes when said brushes do not abut said commutator.

16. The fuel pump as claimed in claim 11, wherein said engaging member engages a portion of said brushes that connect to said connection member.

17. The fuel pump as claimed in claim 11, wherein one of said brushes, said terminal member, said engaging member and said connection member form a subassembly.

18. The fuel pump as claimed in claim 17, further comprising a terminal member, and a connection member, wherein:

said engaging member comprises a pair of engaging members; and said each of said brushes, said terminal member, said engaging member and said connection member form a subassembly.

19. The fuel pump as claimed in claim 1, wherein said brushes and said commutator are disposed in an axial line of said cover.

20. A fuel pump comprising:

a housing; a pump section disposed in said housing;

a motor section including a commutator, disposed in said housing, for driving said pump section;

a cover disposed at an end of said housing on a side of said motor section, said cover being composed of two half areas defined by a center plane including a center axis of the cover, said cover having a pair of spring holes and a pair of brush holes disposed in one of said half areas;

a pair of brushes disposed in said pair of brush holes to be in contact with said commutator; and a pair of springs, disposed in said pair of spring holes for biasing said brush against said commutator; and a pair of terminal members each having a first portion to be electrically connected to a power source and a second portion for limiting movement of said brushes toward said motor section, said first portions of said terminal members being disposed in the other of said half areas of said cover to penetrate said cover.

21. The fuel pump as claimed in claim 20, wherein said cover has a fuel discharge passage at a central portion thereof.

22. The fuel pump as claimed in claim 21, wherein said pair of terminal members and said pair of brushes are disposed to surround said fuel discharge passage.

* * * * *